US005685374A

United States Patent [19]

Schmidt et al.

[11] Patent Number: 5,685,374

[45] Date of Patent: Nov. 11, 1997

[54] WELL COMPLETIONS IN WEAKLY CONSOLIDATED FORMATIONS

[75] Inventors: Joseph H. Schmidt; Frank E. Bergren; Michael L. Bill; Donald F. Scheve, all of Anchorage, Ak.

[73] Assignee: Atlantic Richfield Company, Los Angeles, Calif.

[21] Appl. No.: 601,192

[22] Filed: Feb. 14, 1996

[51] Int. Cl.[6] ..... E21B 43/00

[52] U.S. Cl. ..... 166/369

[58] Field of Search ..... 166/267, 369, 166/372, 75.12, 75.15; 299/7

[56] References Cited

U.S. PATENT DOCUMENTS

| | | | |
|---|---|---|---|
| 4,830,110 | 5/1989 | Perkins | 166/228 |
| 5,109,933 | 5/1992 | Jackson | 175/66 |
| 5,129,469 | 7/1992 | Jackson | 175/66 |
| 5,226,749 | 7/1993 | Perkins | 405/128 |
| 5,236,605 | 8/1993 | Warncke | 166/267 X |
| 5,303,786 | 4/1994 | Prestridge et al. | 175/66 |
| 5,314,265 | 5/1994 | Perkins et al. | 405/128 |
| 5,387,737 | 2/1995 | Schmidt et al. | 588/250 |

*Primary Examiner*—William P. Neuder
*Attorney, Agent, or Firm*—Michael F. Martin

[57] ABSTRACT

Weakly consolidated hydrocarbon fluid bearing earth formation zones having a cohesive strength of about 500 psi or less are produced by completing a well penetrating the zone and initiating production of solids laden fluid from the zone through the well to generate a near wellbore cavity. Production of solids laden fluid is continued until the cavity grows to a point wherein the fluid velocity across the cavity face decreases to a value below the solids particulate transport velocity wherein continued production of fluid will result in a very low or negligible rate of production of solids particulates. Solids particulates are separated from the produced mixture at the surface, the solids are treated to reduce the particle size and reinjected in a slurry into a disposal well for disposal in a hydraulically fractured or disaggregated formation zone remote from the production zone. Cavity growth and production may be carried out by throttling a free flowing well or by artificial lift, preferably utilizing power fluid and a hydraulic jet pump or gas lift techniques.

24 Claims, 4 Drawing Sheets

WELL COMPLETIONS IN WEAKLY CONSOLIDATED FORMATIONS

FIELD OF THE INVENTION

The present invention pertains to a method for completing a fluid production well in a weakly consolidated formation by allowing the production of solids fines from the near wellbore region to generate a cavity which will increase effective wellbore radius and result in enhanced production from a formation. The produced solids are separated and processed for reinjection into a disposal well, for example.

BACKGROUND

The production of hydrocarbon fluids, particularly, from weakly consolidated subterranean formations, has been a longstanding problem. Many weakly consolidated formations which are capable of yielding substantial quantities of hydrocarbons, such as crude oil, have not been produced because of the excessive quantities of solids fines which are carried to the surface with the produced fluid. Costs associated with separation and disposal of solids particulates and recent regulatory restrictions on disposal methods have heretofore rendered many weakly consolidated formations uneconomical to produce.

One widely used conventional method of producing fluids from relatively weakly consolidated formations is to install a solids separation system in the wellbore adjacent the formation zone being produced. Such systems usually comprise a so-called gravel packing wherein a slotted conduit or liner is inserted in the wellbore and a layer of relatively coarse sand or gravel is packed around this conduit to act as a filter to prevent the production of sand and other solids fines into the well for recovery with the production fluid. Conventional sand control techniques, such as gravel pack installations and the injection of polymer resins into the formation production zone, for example, can reduce fluid production rates by as much as 75% of expected recovery rates and may significantly reduce total production of fluids from a weakly consolidated formation.

Accordingly, substantial hydrocarbon fluid reservoirs have been overlooked or not considered for commercial production due to the costs and other disadvantages associated with conventional sand control techniques. However, the assignee of the present invention has developed methods and systems for processing particulate solids associated with well drilling, completion and the production of hydrocarbon fluids from wells which result in the production of substantial quantities of sand, formation fines and similar particulate solids. U.S. Pat. Nos. 5,109,933 issued May 5, 1992 and 5,129,469 issued Jul. 14, 1992, both to J. E. Jackson, describe a system and method for preparing and injecting slurries of particulate solids for disposal in subterranean wells. U.S. Pat. Nos. 5,226,749 issued Jul. 13, 1993 and 5,314,265 issued May 24, 1994 to Perkins describe techniques for disposing of slurries in hydraulically fractured earth formations. The development of the processes described in the above-identified patents has substantially solved the problem of dealing with particulate solids produced during well drilling and production of fluids from subterranean wellbores. With the realization that the disposal of formation fines, i.e. sand, can be dealt with, particularly wherein disposal wells have been or can be easily drilled in or near oil fields from which the solids are being produced, has given rise to consideration of methods for production of fluids from weakly consolidated formations. It is to these ends that the present invention has been developed.

SUMMARY OF THE INVENTION

The present invention provides a unique method for producing fluids from wells penetrating weakly consolidated subterranean earth formations. In particular, the method contemplates improvements in the production rates of hydrocarbon fluids from weakly consolidated formations, namely, formations generally having a cohesive strength of less than about 2000 psi and more preferably less than about 500 psi, for example.

In accordance with one important aspect of the invention, fluids are produced from weakly consolidated earth formations by allowing or stimulating the production of fluid together with formation fines at a rate which will generate a near wellbore cavity in the vicinity of a perforated casing or even a so-called open hole wellbore. Fluid production is caused to occur at a rate which will allow the wellbore cavity to increase until the fluid velocity across the cavity face decreases below that which is required to transport particulate solids from the formation to the well thereby inhibiting further growth of the cavity.

In accordance with another aspect of the invention, a method of producing hydrocarbon fluids from weakly consolidated formations is provided wherein a cavity is formed in the formation in the near wellbore region, which cavity increases the effective wellbore radius and thus leads to even higher fluid production rates. Such a process is particularly advantageous for producing fluids from formations which have a cohesive strength less than about 500 psi and which are occupied by a relatively heavy and substantially dead formation fluid, such as crude oil.

In accordance with yet another aspect of the invention, a method is provided for completing and producing fluids from a weakly consolidated formation by a well penetrating the formation wherein solids produced with the production fluid (sand, formation fines, etc.) are separated at the surface from the produced fluid and at least a portion of the produced fluid may be used as a power fluid in a hydraulic jet pump, for example, to provide artificial lift for the production fluid. Although production may, initially, be free-flowing and controlled by a surface throttling valve or choke to control the wellbore cavity development, fluid production may eventually require artificial lift from a hydraulic jet pump using a power fluid such as crude oil, water or any other fluid which, preferably, may be compatible with or enhance the solids separation process once the produced mixture is brought to the surface. Artificial lift may also be provided by gas injection into the well.

The present invention still further provides a method for completion of a well with an increased effective wellbore radius in a weakly consolidation formation by creating a cavity in the near wellbore region through controlled initial production of fluids and formation fines or sand from the near wellbore region until a cavity has developed of sufficient size wherein the cavity face area together with the rate of production of fluid results in a fluid velocity across the cavity face at a level which will not transport solids particulates from the formation to and through the well.

Those skilled in the art will further appreciate the above-mentioned aspects of the invention together with other superior features and advantages upon reading the detailed description which follows in conjunction with the drawing.

DESCRIPTION OF THE PREFERRED EMBODIMENTS

Figure 1:
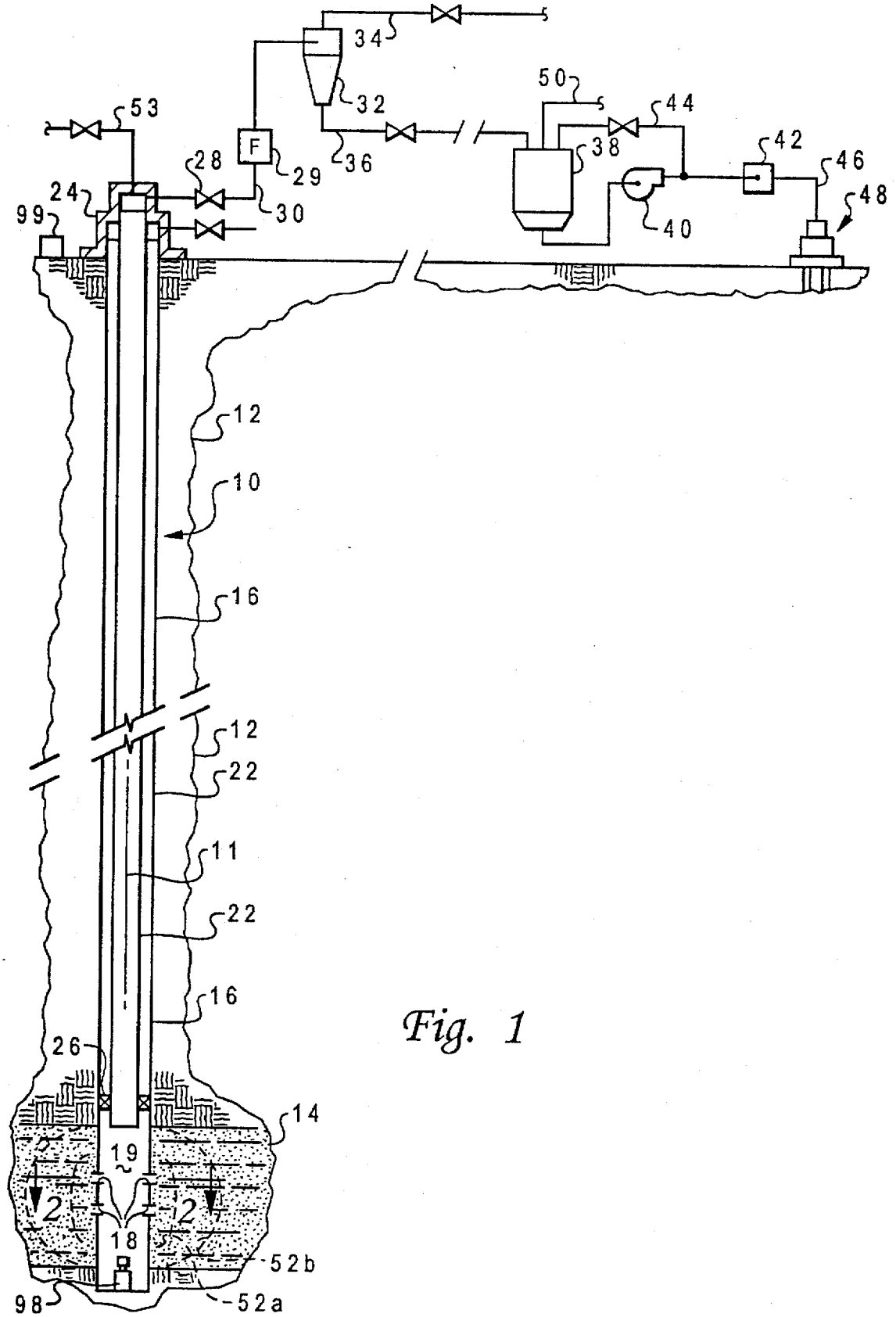
FIG. 1 is a schematic diagram of a well penetrating a weakly consolidated earth formation and adapted to produce fluids from the formation to generate a cavity in the production zone.

In the description which follows, like elements are marked throughout the specification and drawing with the same reference numerals, respectively. The drawing figures are not intended to be to scale and certain elements which are conventional and known to those skilled in the art of the present invention are shown in somewhat generalized or schematic form in the interest of clarity and conciseness.

Referring to FIG. 1, there is shown in somewhat schematic form a fluid production well 10 which has been drilled into an earth formation 12 including a rather weakly consolidated zone 14 containing a recoverable quantity of hydrocarbon fluid such as crude oil. The zone 14 may have a cohesive strength of greater than 500 psi, however, the method of the present invention is optimally implemented in producing formations having a cohesive strength generally less than 500 psi. One formation which, it is contemplated, can be satisfactorily produced by the method of the invention is disposed in the North Slope oil producing region of Alaska, and, in particular, includes a field known as West Sak which is disposed at a depth of 3,000 feet to 4,000 feet below the surface and has a cohesive strength in the range of 50 psi to 500 psi.

The well 10 may include a conventional casing structure 16 having a plurality of perforations 18 formed therein to communicate a wellbore 19 with the formation zone 14. The well 10 also includes a conventional tubing string 22 extending from a conventional wellhead 24 and secured in the casing at the lower end of the tubing string by a conventional packer 26. If the formation pressure in the zone 14 is sufficient, the well 10 may, at least initially, be free flowing and fluid production rate controlled by a throttling valve or choke 28 interposed in a flowline 30. The flowline 30 is operable for conducting a mixture of produced oil and particulate solids, including sand, formation fines and other particles which are heavily dispersed in the oil. The flowline 30 is connected to suitable separation means 32 for separating solids particulates from fluids. A single stage centrifugal or cyclone type separator is illustrated. Other separation facilities, including multi-stage centrifugal or cyclone type separators, may be utilized. Additional separation techniques including mixing the produced fluid with viscosity reducing and solids particle coalescing substances may be used. The produced fluid and particulates mixture may require heating to reduce the fluid viscosity to enhance separation.

Production fluids separated by the separator means 32 is conducted to further processing or transport apparatus, not shown, through a flowline 34 and separated sand and other solids particulates is conducted from the separator means 32 through a conduit 36. As mentioned above, additional solids separation equipment, not shown, may be interposed in the conduit 36 to further strip recoverable hydrocarbon fluids from the solids particulates before mixing the solids particulates with a transport fluid, such as water, for conduction to a storage and mixing tank 38.

The storage tank 38 may be part of a solids treatment and disposal system such as described in U.S. Pat. Nos. 5,109,933 issued May 5, 1992 and 5,129,469 issued Jul. 14, 1992, both to James E. Jackson and both assigned to the assignee of the present invention. A somewhat simplified version of the system described in the aforementioned patents is shown in FIG. 1 and includes a circulating and particle size reduction pump 40 connected to the storage tank 38 and to an injection pump 42. The pump 40 is also connected to a conduit 44 for recirculation of a slurry of particulate solids and a carrier fluid back to the storage tank 38 for mixing and for reducing the particle size of the particulate solids to a size suitable for injection into an earth formation adjacent to the formation 12 but suitably spaced therefrom to provide for isolation of the injected solids from the production reservoir zone 14. The injection pump 42 is connected by way of a conduit 46 to a solids slurry injection and disposal well 48 as shown schematically in FIG. 1. The storage and mixing tank 38 is also in communication with a source of fluid, such as water, by way of a conduit 50, for preparing a slurry of suitable characteristics for injection through the disposal well 48. The slurry of formation fines, sand and other particulate solids which have been reduced in particle size using the methods described in the aforementioned patents, may be injected into disposal zones in a suitable formation using the methods described in U.S. Pat. Nos. 5,226,749 issued Jul. 13, 1993 and 5,314,265 issued May 24, 1994 to Perkins and Perkins et al., respectively, and assigned to the assignee of the present invention.

Figure 2:
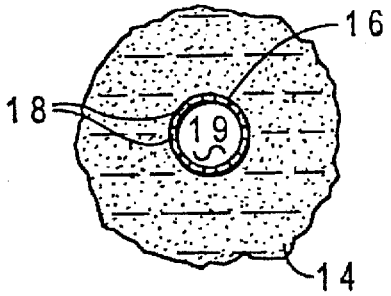
FIG. 2 is a section view taken along the line 2—2 of FIG. 1 and showing the conditions of the formation at the onset of production of fluids and particulate solids into the wellbore.
Figure 3:
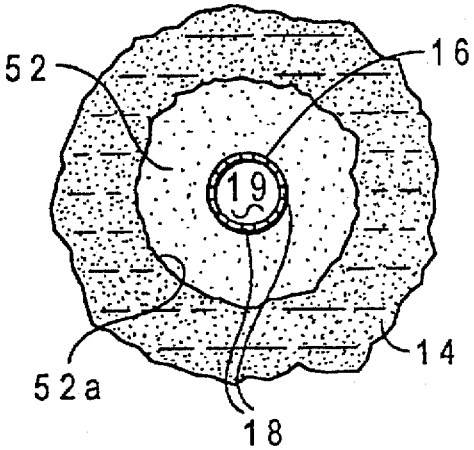
FIG. 3 is a view taken from the same line as FIG. 2 and showing the growth of the cavity in the near wellbore region of the formation to a size wherein fines are still being produced from the formation into the well.
Figure 4:
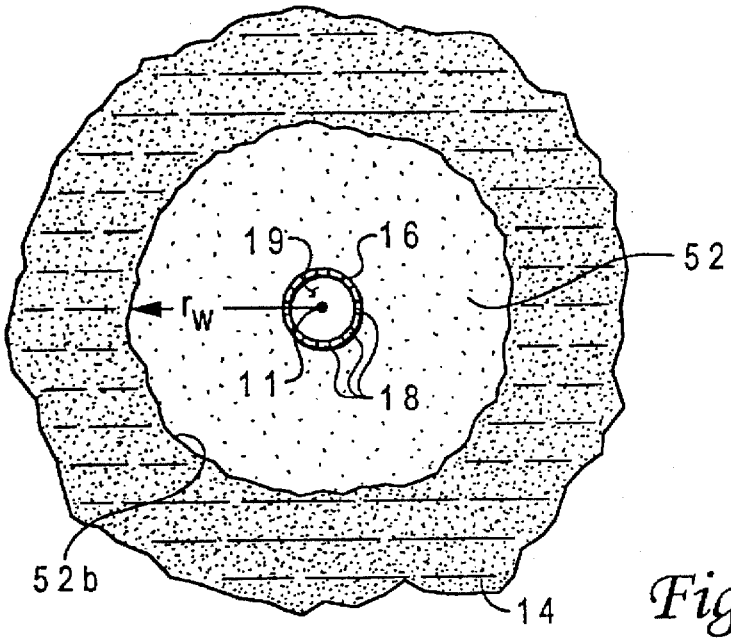
FIG. 4 is a view taken from the same line as the views of FIG. 2 and FIG. 3 and showing the size of the cavity at which the production of solids and cavity growth is substantially complete.

If, upon perforating the casing 16, formation pressure is sufficient to cause the well 10 to be free flowing, production of the fluid and solids mixture from the formation zone 14 into the wellbore 19 and through the tubing string 22 may be controlled by choke 28 in such a way that fluid velocity is, initially, sufficient to begin generating a cavity, such as the generally cylindrical cavity 52, as indicated in FIG. 1. FIGS. 2, 3 and 4, which are taken along the line 2—2 of FIG. 1, show the condition of the formation zone 14 in the vicinity of the well casing 16 at various stages in the completion method of the invention. As shown in FIG. 2, initially, the formation zone 14 surrounds the casing 16 and is contiguous therewith. A suitable pattern of uniformly circumferentially spaced perforations 18 is provided in the casing 16 to provide inflow of the formation fluid/solids mixture or slurry to the wellbore 19 in a circumferentially uniform pattern. Initially, production of fluid from the formation zone 14 is controlled to be at a rate which will generate a near wellbore cavity such as the cavity 52 which will grow radially from the wellbore, as indicated in FIGS. 3 and 4, and delimited by a cavity wall **52*a*, FIG. 3, which is assumed to be substantially cylindrical. A fluid and particulates mixture will be produced from the formation zone 14 until the cavity grows to a size indicated in FIG. 4 and defined by cavity wall 52*b*. At the condition indicated in FIG. 4, the fluid velocity across the face or cavity wall 52*b* is reduced to a rate which will be less than what is necessary to transport solids particles toward the wellbore 19 and the cavity size will not grow any further, however, the facial area of cavity wall 52b is substantially greater than 52a, thus increasing the effective wellbore radius with respect to central axis 11, FIG. 1**, and resulting in an improved fluid production rate in accordance with the radial form of Darcy's law which is discussed further herein.

Accordingly, the cavity 52 will grow until a somewhat naturally limiting condition exists when the wellbore face area is such that fluid velocity across the face is less than is required to transport solids particles to the wellbore 19. For a formation zone of minimal thickness, say about ten feet, the cavity 52 will be generally cylindrical in form. The geometry of the cavity will also be dictated to some extent by the number of perforations arranged vertically and circumferentially in the casing 16. For formation zones having a thickness substantially greater than that mentioned above, the cavity face 52b may become somewhat spherical in shape, again somewhat dependent on the distribution of perforations 18. Although the well 10 is typically completed using a conventional casing 16, it is possible, in some instances, to provide for completing the well in a so-called open hole condition, that is without any casing or similar supporting structure in the zone 14.

As the well 10 is produced, initially, to create growth of the cavity 52, the fluid and solids mixture flowing from the well will be separated in the separator means 32 and the solids particulates conveyed to the tank 38 for further processing and reinjection through the injection well 48 into a subterranean disposal zone. As the cavity 52 stabilizes in size, as indicated by the cavity shown in FIG. 4, the production of solids particulates will decrease substantially and the amount of separation required will also be reduced. The well 10 may then be required to be produced using artificial lift means, such as described hereinbelow. The well 10 may, of course, initially require production of the liquid and particulate solids mixture by artificial lift techniques and flow of formation fluid may also require some form of stimulation. It is contemplated that the injection of gas, into and through injection wells arranged around the production well 10 in a suitable pattern may cause the substantially dead formation fluid to "swell", thereby effectively initiating or enhancing the flow of fluid toward the production well. Moreover, the viscosity of the production fluid may be such as to benefit from steam or hot water injection by way of a conduit 53 connected to wellhead 24, FIG. 1, whereby alternating steam or water injection and formation fluid production cycles are carried out.

Figure 5:
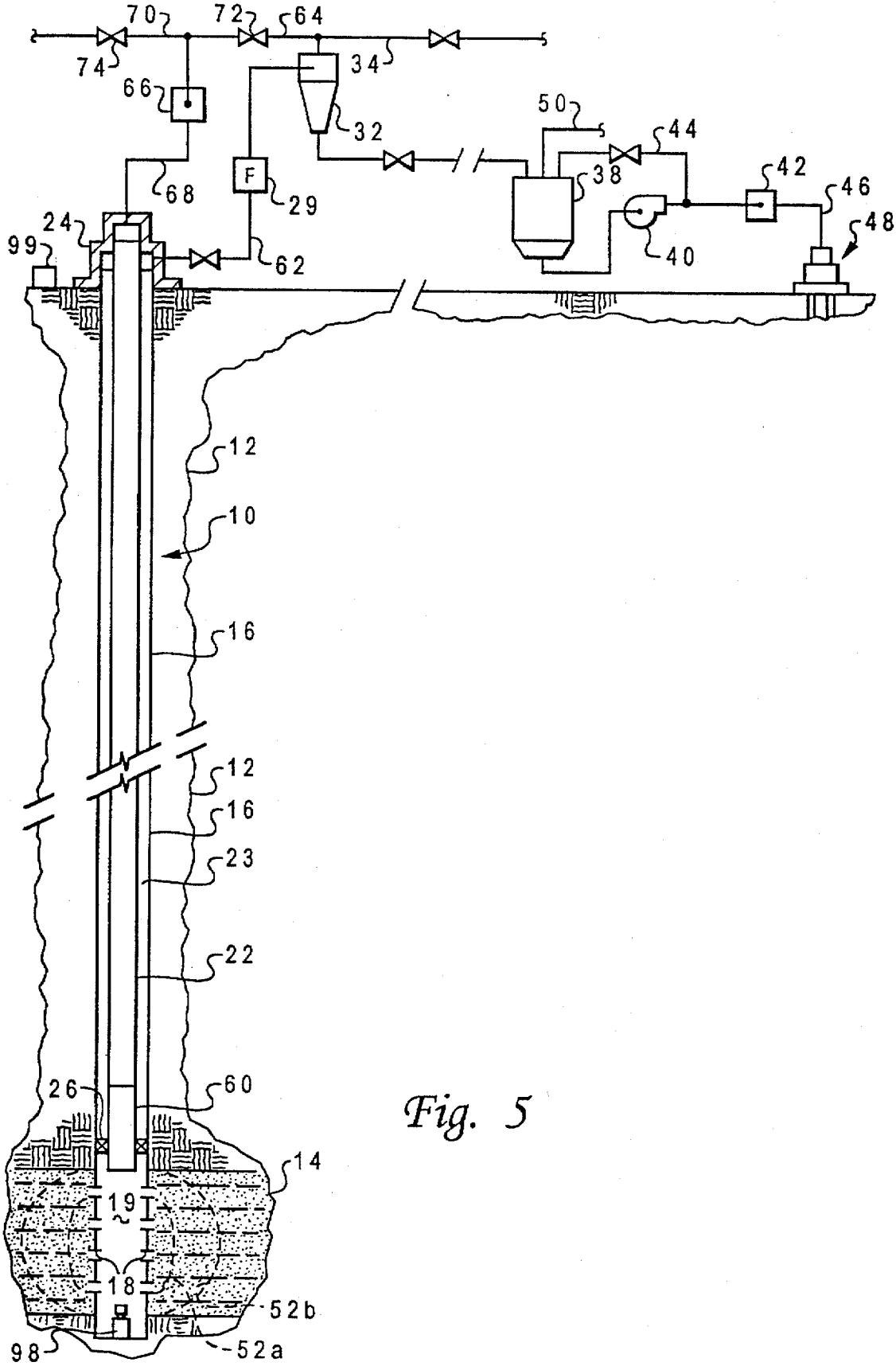
FIG. 5 is a schematic diagram similar in some respects to FIG. 1 and showing a system for artificial lift of production fluid from the well.

FIG. 5 illustrates a modified arrangement of the well 10 wherein artificial lift has been implemented to stimulate and continue the production of fluid from the zone 14. In the arrangement of FIG. 5, a hydraulic jet pump 60 is shown installed at the distal end of the tubing string 22. The jet pump 60 may be of a type commercially available such as from TRICO Industries, Inc., Gardena, Calif. A high volume type C pump from the abovementioned supplier may be suitable for pumping a relatively viscous mixture of formation fluid and solids particulates. In such an arrangement, power fluid is conducted down through the tubing string 22 and entrains a fluid-solids mixture from the wellbore 19 for production up through the annular space 23 between the tubing string 22 and the casing 16. The fluid-solids mixture is then conducted by way of a conduit 62 to the solids separation means 32 and substantially solids free liquid is conducted from the separation means 32 by way of flowline 34.

A portion of the separated fluid may be drawn off from flowline 34 through a conduit 64 to a pump 66 which is connected to tubing string 22 by way of a conduit 68. Accordingly, power fluid is reclaimed from the solids separation means 32 and reused for operating the jet pump 60. A conduit 70 is also connected to conduit 68 and is adapted to be connected to a source of power fluid, not shown. Suitable control valves 72 and 74 may be interposed in the conduits, as shown, for controlling the flow of power fluid to the pump 66.

As indicated by the system illustrated in FIG. 5, the power fluid may comprise the separated and substantially solids free crude oil produced from the well 10 and mixed with a lighter, less viscous liquid such as crude oil or a refined hydrocarbon fluid to provide a suitable power fluid for lifting the liquid-solids mixture from the wellbore 19 through the annulus 23. The hydraulic jet pump 60 may be of a type wherein the flow paths may be reversed from that described above, that is, power fluid is supplied through the casing annulus 23 and production flows up through the tubing string 22. In this regard, the conduits 62 and 68 would require to be reversed as to their connecting points with the separator means 32 and the pump 66, as will be appreciated by those skilled in the art. Utilization of a hydraulic jet pump for lifting the relatively heavy and solids laden production fluid is considered advantageous in that the power fluid tends to dilute and enhance the flow of production fluid from the wellbore 19 and a hydraulic jet pump is less likely to be damaged by the solids content of the production fluid.

Figure 6:
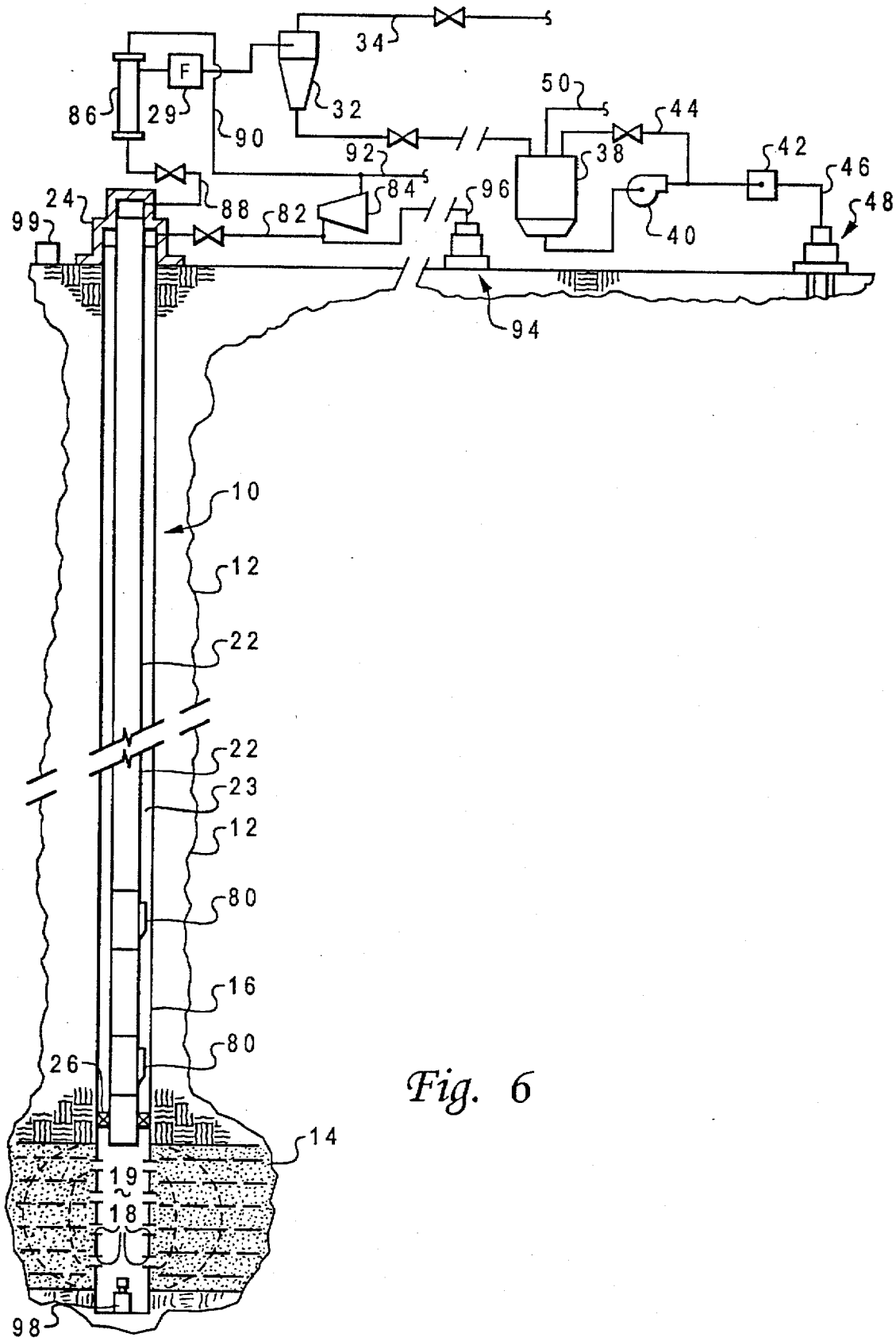
FIG. 6 is a schematic diagram of a well such as shown in FIGS. 1 and 5 but including a system for generating artificial lift using pressure gas.

FIG. 6 illustrates a further modification of an arrangement for producing solids laden fluid from formation zone 14 through a further modification of the well 10. In FIG. 6, the tubing string 22 is modified to include one or more gas lift mandrels 80 interposed therein and of conventional construction. The gas lift mandrels 80 are supplied with pressure gas through the annulus 23 by way of a supply conduit 82 connected to a source of pressure gas, such as a compressor 84. The solids laden production fluid is conducted up through the tubing string 22, including the gas lift mandrels 80, in a conventional manner and gas may be separated from the fluid mixture by a suitable separator 86 interposed in a flowline 88 connected to the wellhead 24 and in communication with the tubing string 22. The separator 86 may be a centrifugal type utilizing a spiral auger flite interposed in a conduit and of a type described in U.S. Pat. No. 5,431,228 issued Jul. 11, 1995 to Weingarten et al. and assigned to the assignee of the present invention. Gas separated from the production fluid-solids mixture is conducted by way of a conduit 90 to the compressor 84 or to another process stream, not shown. Additional gas needed for the gas lift process or for injection into the formation 12 may be supplied by a conduit 92.

As shown in FIG. 6, the compressor 84 is also operable to be connected to one or more injection wells 94, one shown, by way of a conduit 96 for injection of gas into the formation 12 in a suitable pattern to stimulate flow of the production fluid solids mixture toward the wellbore 19. The gas lift system illustrated in FIG. 6 is also advantageous for artificially lifting a solids laden fluid mixture to the surface in that problems associated with excess wear and plugging of mechanical pumps are eliminated. Moreover, the use of injection gas and the use of gas as a lifting fluid can be advantageous in that, in certain hydrocarbon production fields, it is readily available.

The aforedescribed systems and methods for producing fluids from a weakly consolidated earth formation zone are advantageous and unique in that the method contemplates at least an initial production of a substantial quantity of formation solids along with formation fluids. Solids separation and disposal, in particular, is enhanced by treating the solids for reinjection into an earth formation at a suitable injection well remote from the production formation. The operation of the embodiments shown in FIGS. 1, 5 and 6 are believed to be understandable to those of skill in the art from the foregoing description. however, briefly, once the well 10 has been drilled and cased and the casing 16 perforated to form the perforations 18, production is initiated at a controlled rate by any of the three systems described. In particular, if the well is free flowing under pressure in the formation zone 14, the flow rate of the fluid/solids mixture is controlled by a suitable valve interposed in the flow path such as the choke 28 interposed in conduit 30 at the surface of formation 12.

A suitable pressure sensor 98 may be interposed in the wellbore 19 to sense bottom hole pressure, and ambient or nominal pressure in zone 14 may be determined at a shut-in condition of the well, also from the sensor 98. The sensor 98 is adapted for transmitting pressure signals to the surface for monitoring by suitable signal receiving means 99. The sensor 98 and the signal receiving means 99 may be of a type such as described in U.S. Pat. Nos. 4,691,203 issued Sep. 1, 1987 to Rubin et al. or 5,091,725 issued Feb. 25, 1992 to Gard, for example. The production flow rate of solids laden fluid may then be controlled to generate an effective wellbore radius as described above. By calculation of the effective wellbore radius from the radial form of Darcy's law and monitoring the solids content of the fluid being produced, the cavity size may be determined. Alternatively, the well 10 may be allowed to produce somewhat uncontrolled until the cavity size increases to a point wherein the fluid velocity across the cavity face **52*b* is less than the transport velocity required to entrain solids particulates from the formation zone 14. If the systems illustrated and described in conjunction with FIGS. 5 and 6 are being implemented, the production rate may be controlled by the amount of power fluid or lift gas conducted to the well 10 for operation of the artificial lift mechanisms associated therewith. Assuming steady state flow conditions in the reservoir zone 15, knowledge of certain formation conditions, including the wellbore bottom hole pressure ($p_w$) and the formation pressure at the outer radius of the drainage field for the well ($p_e$), the effective radius ($r_w$) of the cavity wall 52*b* with respect to the central axis of the well 10** may be determined from the following equation:

$$q = \frac{0.007082kh(p_e - p_w)}{B\mu\ln(r_e/r_w)} \quad \text{(a)}$$

wherein q is the flow rate in standard barrels per day (42 U.S. gallons per barrel), k is the formation permeability in millidarcies, h is the formation thickness in feet, B is the formation volume factor in reservoir barrels per stock tank barrel, μ is the fluid viscosity in centipoises and $r_e$ is the external radius of the drainage field for the well in question, in feet, a value which may be predetermined, along with the other constants, for the particular formation zone in question. Volumetric flow rates may be determined by a suitable flowmeter 29 interposed in the production flowline. Equation (a) set forth above is discussed further in "Advances in Well Test Analysis" by Robert C. Earlougher, Jr., Society of Petroleum Engineers, Richardson, Texas 1977. Accordingly, with known pressures and flow rates, the equation above may be solved for the effective wellbore radius ($r_w$). Conversely, the effective wellbore radius ($r_w$) may be limited by controlling the flow rate of fluid produced from the well.

Although preferred embodiments of the invention have been described in detail herein, those skilled in the art will recognize that various substitutions and modifications may be made to the invention without departing from the scope and spirit of the appended claims.

What is claimed is:

1. A method for completing a well penetrating a subterranean formation and producing fluids through said well from a weakly consolidated zone in said formation, comprising the steps of:

extending said well into said zone; and producing a solids laden fluid mixture from said zone into and through said well at a rate which will create a cavity in the near wellbore region of said zone.

2. The method set forth in claim 1 including the step of:

continuing to produce said solids laden fluid mixture into and through said well at a rate which will effect growth of said cavity generally radially outward from said well until the flow velocity of fluid in said zone flowing across a face defining said cavity decreases to a value less than the transport velocity of the solids particulates of said zone.

3. The method set forth in claim 1 including the step of:

monitoring the bottomhole pressure in said well and comparing the bottomhole pressure with the nominal fluid pressure in said zone and the flow rate of fluid produced from said zone to determine the effective radius of said cavity.

4. The method set forth in claim 1 including the steps of:

separating solids from said solids laden fluid mixture; and forming a slurry of solids separated from said solids laden fluid mixture and reinjecting said solids into an earth formation.

5. The method set forth in claim 1 including the step of:

initiating the flow of solids laden fluid mixture from said well by throttling the flow of said solids laden fluid mixture through a well conduit extending within said well and in communication with a wellbore portion extending within said zone.

6. The method set forth in claim 1 including the step of:

controlling the flow of solids laden fluid mixture from said wellbore portion by pumping said solids laden fluid mixture from said wellbore portion with the aid of a power fluid.

7. The method set forth in claim 6 wherein:

said power fluid comprises lift gas which is injected into said well for entraining said solids laden fluid mixture therewith.

8. The method set forth in claim 6 wherein:

said power fluid comprises a liquid which is injected into a conduit extending within said well and through a jet pump in communication with said conduit for entraining said solids laden fluid mixture with said power fluid.

9. The method set forth in claim 7 including the step of:

recovering power fluid for reinjection into said well by separating said power fluid from a mixture of said power fluid and said solids laden fluid mixture.

10. The method set forth in claim 9 including the step of:

separating solids from said mixture of power fluid and solids laden fluid mixture and transporting said separated solids with a quantity of one of said power fluid and fluid produced from said zone to a system for forming a slurry of solids fines in a fluid which may be injected into a disposal well.

11. The method set forth in claim 1 including the step of:

injecting one of steam and other heated fluid into said zone to stimulate the production of formation fluid from said zone.

12. The method set forth in claim 1 wherein:

said zone includes a cohesive strength of not more than about 500 psi.

13. A method for producing formation fluids from a weakly consolidated zone in a subterranean earth formation, said zone having a cohesive strength less than about 2000 psi, comprising the steps of:

extending a production well into said zone;

initiating production of a solids laden fluid mixture from said zone into and through said well at a rate which will generate a cavity in said zone in the near wellbore region; and continuing the production of fluid from said zone at a rate which will cause said cavity to grow until a facial area defining said cavity is sufficiently great that the fluid flow rate across said face is at a velocity less than the particle transport velocity of particulate solids in said zone.

14. The method set forth in claim 13 including the step of:

stimulating the production of said solids laden fluid mixture by injecting a heated fluid into said well to reduce the viscosity of formation fluid in said zone adjacent to said cavity.

15. The method set forth in claim 13 including the step of:

injecting gas into said zone to cause formation fluid to swell and flow toward said well.

16. The method set forth in claim 13 including the steps of:

separating solids from said solids laden fluid mixture;

reducing the particle size of said solids; and injecting a slurry of said solids and a carrier fluid into an earth formation.

17. The method set forth in claim 13 including the steps of:

separating gas from said solids laden fluid mixture;

separating solids from said solids laden fluid mixture;

forming a slurry of said solids and a carrier liquid; and reinjecting said solids into an earth formation.

18. A method for recovering hydrocarbon liquid from an earth formation zone comprising a mixture of said hydrocarbon liquid and solids particulates having a cohesive strength less than about 500 psi, comprising the steps of:

extending a well into said formation zone having a wellbore portion in communication with said formation zone;

determining the effective radius of said formation zone which will drain hydrocarbon liquid into said wellbore, the formation permeability in said zone, the thickness of said zone, the viscosity of said hydrocarbon liquid in said zone and the nominal pressure in said zone within said radius;

initiating production of a solids laden fluid mixture from said zone through said well to create a cavity in the near region of said wellbore while monitoring the pressure in said wellbore and the flow rate of said solids laden fluid mixture; and controlling the flow rate of said solids laden fluid mixture from said zone into and through said well to generate a cavity in said zone having a radius which defines a cavity face of sufficient size that the fluid flow rate across said face is at a velocity less than the transport velocity of solids in said zone in said hydrocarbon liquid.

19. The methods set forth in claim 18 wherein:

the step of controlling the flow rate of production of said solids laden fluid mixture is carried out by throttling said flow rate of said solids laden fluid mixture through a conduit in communication with said wellbore.

20. The method set forth in claim 18 wherein:

the flow rate of said solids laden fluid mixture is controlled by controlling the flow rate of a lifting fluid injected into said well for entraining said solids laden fluid mixture to flow from said wellbore portion through said well.

21. The method set forth in claim 18 including the step of:

stimulating the flow of said solids laden fluid mixture into said well by injecting a fluid into one of said well and said formation zone.

22. The method set forth in claim 18 including the steps of:

separating solids from said solids laden fluid mixture;

forming a slurry of said solids and a carrier fluid; and injecting said solids into an earth formation.

23. The method set forth in claim 22 including the step of:

providing said carrier fluid as one of said hydrocarbon liquid and a lifting fluid for lifting said solids laden fluid mixture through said well.

24. The method set forth in claim 22 including the step of:

reducing the particle size of said solids prior to injection of said solids into said earth formation.

* * * * *